US006081179A

United States Patent [19]

Kato

[11] Patent Number: 6,081,179

[45] Date of Patent: Jun. 27, 2000

[54] SUPERCONDUCTING COIL

[75] Inventor: Takeshi Kato, Osaka, Japan

[73] Assignee: Sumitomo Electric Industries, Ltd., Osaka, Japan

[21] Appl. No.: 09/073,953

[22] Filed: May 7, 1998

[30] Foreign Application Priority Data

May 8, 1997 [JP] Japan ..... 9-118152
Oct. 15, 1997 [JP] Japan ..... 9-281622

[51] Int. Cl.[7] ..... H01F 5/00

[52] U.S. Cl. ..... 335/299; 335/216; 335/300; 505/892

[58] Field of Search ..... 335/216, 296, 335/299, 300; 324/318, 319, 320, 321; 505/892, 894, 884, 888

[56] References Cited

U.S. PATENT DOCUMENTS

| | | | |
|---|---|---|---|
| 4,682,134 | 7/1987 | Laskaris | 335/216 |
| 4,933,657 | 6/1990 | Bessho et al. | 335/299 |
| 5,113,165 | 5/1992 | Ackerman . | |
| 5,317,879 | 6/1994 | Goldberg et al. . | |
| 5,686,876 | 11/1997 | Yamamoto et al. | 335/216 |

FOREIGN PATENT DOCUMENTS

| | | |
|---|---|---|
| 0 472 333 | 2/1992 | European Pat. Off. . |
| 15 14 707 | 6/1969 | Germany . |
| 58-050711 | 3/1983 | Japan . |
| 61-154019 | 7/1986 | Japan . |
| 61-229306 | 10/1986 | Japan . |
| 62-93914 | 4/1987 | Japan . |
| 63-009903 | 1/1988 | Japan . |
| 63-196016 | 8/1988 | Japan . |
| 2-302681 | 12/1990 | Japan . |
| 6-151168 | 5/1994 | Japan . |
| 6-174349 | 6/1994 | Japan . |
| 6-302869 | 10/1994 | Japan . |
| 7-142245 | 6/1995 | Japan . |
| 8-316022 | 1/1996 | Japan . |
| 8-222430 | 8/1996 | Japan . |
| 9-275009 | 10/1997 | Japan . |

*Primary Examiner*—Lincoln Donovan
*Attorney, Agent, or Firm*—Foley & Lardner

[57] ABSTRACT

A structure of a superconducting coil capable of improving cooling efficiency is provided. The superconducting coil is formed by stacking a plurality of double pancake coils with each other. The double pancake coils are stacked in the direction of a coil axis. A cooling plate is arranged between the double pancake coils.

17 Claims, 5 Drawing Sheets

SUPERCONDUCTING COIL

BACKGROUND OF THE INVENTION

1. Field of the Invention

The present invention relates to a superconducting coil, and more specifically, it relates to an oxide high-temperature superconducting coil particularly employable under a relatively high temperature, which can provide a high magnetic field with small power and is applicable to magnetic separation or crystal pulling.

2. Description of the Prior Art

A coil prepared by winding a normal conductor such as copper or a metal superconductor exhibiting superconduction at the liquid helium temperature has been generally employed.

In case of providing a high magnetic field with a coil prepared by winding a copper wire, however, it is necessary to cool the coil, remarkably generating heat, by forcibly feeding water or the like. Therefore, the coil prepared by winding a normal conductor disadvantageously requires high power consumption, and is inferior in compactness and hard to maintain.

On the other hand, the coil prepared by winding a metal superconductor must be cooled to a cryogenic temperature of about 4 K, to disadvantageously result in a high cooling cost. In addition, the coil which is employed under such a cryogenic temperature with small specific heat is so inferior in stability that the same readily causes quenching.

It has been proved that an oxide high-temperature superconducting coil which is employable under a relatively high temperature as compared with the metal superconducting coil allows employment in a region with high specific heat and is remarkably excellent in stability. Thus, the oxide high-temperature superconducting coil is expected as a material for a superconducting magnet which is easy to use.

An oxide high-temperature superconducting wire, which exhibits superconduction at the liquid nitrogen temperature, is relatively inferior in critical current density and magnetic field property at the liquid nitrogen temperature. Under the present circumstances, therefore, the oxide high-temperature superconducting coil is employed as a coil for providing a low magnetic field at the liquid nitrogen temperature.

While the oxide high-temperature superconducting coil is employable as a coil of higher performance at a temperature lower than the liquid nitrogen temperature, liquid helium is too costly and intractable for serving as a practical coolant. To this end, an attempt has been made to cool the oxide high-temperature superconducting coil to a cryogenic temperature with a refrigerator which is at a low operating cost and tractable.

In general, a dip-cooled metal superconducting coil is operated with a current which is considerably smaller than the critical current to be employed in a state hardly generating heat, in order to prevent quenching. Alternatively, a coolant is forcibly fed into the superconducting wire, or the superconducting coil is cooled while defining clearances between turns of the superconducting wire for allowing sufficient passage of the coolant.

On the other hand, a recent conduction-cooled superconducting coil is conduction-cooled from around the same, to be employed in a state hardly generating heat.

The oxide high-temperature superconducting coil can be cooled by a method similar to that for the metal superconducting coil. However, an oxide high-temperature superconducting wire, which has a high critical temperature and is highly stable due to loose normal conductivity transition, is hard to quench. Therefore, the oxide high-temperature superconducting coil is expected to be operated with a high current up to a level close to the critical current. In order to operate the superconducting coil with such a current up to a level close to the critical current, it is necessary to sufficiently cool the superconducting coil. Particularly in conduction cooling with a refrigerator, it is necessary to cool the superconducting coil without increasing its temperature by small heat generation.

However, it is difficult to efficiently conduction-cool the superconducting coil with a refrigerator, due to limitation in cooling ability and cooling path.

In the conventional method, conduction cooling is performed only from around the superconducting coil. While the turns of the superconducting wire are electrically isolated from each other in the superconducting coil, the material employed for such isolation is extremely inferior in heat conduction. In conduction cooling from around the coil, therefore, it is difficult to cool the coil up to its interior with low heat resistance. If small heat generation takes place in the interior of the coil, the temperature of the coil is extremely increased. In the conventional cooling method, therefore, heat generation allowed to the coil is extremely small, and the operating current for the coil is considerably smaller than the critical current.

The oxide high-temperature superconducting coil is expected to be operated with a current closer to the critical current, due to high stability of the oxide high-temperature superconducting wire. Further, the oxide high-temperature superconducting coil tends to gradually generate heat when operated with a current smaller than the critical current, due to a small n value (the way of rise of current-voltage characteristics). In order to operate the oxide high-temperature superconducting coil, therefore, it is necessary to more efficiently cool the coil as compared with the prior art.

The n value is employed in the following relational expression:

$$V(\text{voltage})\,\alpha\left(\frac{I(\text{current})}{I_C(\text{critical current})}\right)^n$$

An oxide superconductor has magnetic field anisotropy. A superconducting wire shaped to orient such an oxide superconductor exhibits magnetic field anisotropy, is intolerant of a magnetic field which is parallel to its C-axis, and causes further reduction of the critical current density. When the oxide superconductor is shaped in the form of a tape, the C-axis is generally oriented perpendicularly to the tape surface.

Japanese Patent Laying-Open No. 8-316022 (1996) discloses a structure of a superconducting coil suppressing frictional heat between turns of an insulated conductor for improving cooling performance between a superconducting wire and a refrigerator. This gazette discloses a superconducting coil which is obtained by coating a superconducting wire, forming a prescribed material when heat-treated at a temperature exceeding 400° C., with an inorganic or mineralized insulator layer for preparing an insulated conductor, winding the insulated conductor for forming a wire part and thereafter heat-treating the same. When the insulated conductor is wound, a fixative of aluminum or an aluminum alloy which is softened or melted at the heat treatment temperature is wound into the wire part. This superconducting coil is prepared by the so-called wind-and-react method (a method of forming a superconductor by reaction heat treatment after winding a coil).

However, this superconducting coil has the following problems: First, the superconducting coil must be heat-treated at a temperature exceeding 400° C. Thus, the material for the insulator layer is limited, to result in a smaller degree of freedom. In general, the material for the insulator layer has a large thickness. Consequently, the ratio of the wire forming the superconducting coil is reduced, to deteriorate the performance of the superconducting coil.

Further, the aforementioned superconducting coil must be heat-treated in inert gas or reducing gas. If the superconducting coil is heat-treated in an oxygen atmosphere, aluminum or the aluminum alloy employed as the fixative is oxidized, to deteriorate heat conductivity. When a superconducting wire consisting of an oxide high-temperature superconductor is employed and heat-treated in inert gas or reducing gas, superconduction properties such as the critical temperature, the critical current density and the like are deteriorated.

In the structure of the aforementioned superconducting coil, further, the fixative is thermally connected to the superconducting wire through the insulator layer, which is inferior in heat conductivity to a metal. Thus, the cooling property is deteriorated.

SUMMARY OF THE INVENTION

Accordingly, an object of the present invention is to provide a structure of a superconducting coil which can improve cooling efficiency, in order to solve the aforementioned problems.

Another object of the present invention is to provide a structure of a superconducting coil obtained by a method (react-and-wind method) of coiling a superconducting wire after forming a superconductor by reaction heat treatment, which can be further improve cooling efficiency.

The superconducting coil according to the present invention, which is prepared by stacking a plurality of pancake coils with each other, comprises a first pancake coil prepared by winding a superconducting conductor, a second pancake coil, prepared by winding a superconducting conductor, which is stacked on the first pancake coil in the direction of a coil axis, and a cooling plate arranged to intervene between the first and second pancake coils.

In the superconducting coil having the aforementioned structure, the cooling plate is arranged to intervene between the first and second pancake coils, whereby the superconducting coil generating heat can be directly cooled. Thus, heat resistance as well as temperature rise of the superconducting coil can be reduced. The material for the cooling plate, which is preferably excellent in heat conduction, is not particularly restricted.

In the superconducting coil according to the present invention, the cooling plate is preferably arranged on a portion providing a magnetic field in a direction perpendicular to the coil axis.

In this case, the cooling plate is arranged on a portion whereto a magnetic field is readily applied from the exterior in the direction perpendicular to the coil axis, or whereon a magnetic field is readily provided. Thus, the cooling plate can be arranged on a portion of the coil remarkably generating heat. Therefore, heat generation of the coil can be efficiently suppressed while minimizing reduction of a coil packing ratio resulting from arrangement of the cooling plate. The term "coil packing ratio" indicates the volume ratio of the superconducting conductors forming the superconducting coil themselves to the delivery volume of the overall superconducting coil.

In the superconducting coil according to the present invention, the cooling plate is preferably arranged on an end portion of the superconducting coil in the direction of the coil axis.

In this case, temperature rise of the coil can be efficiently suppressed since the superconducting coil remarkably generates heat on the end portion if formed by bismuth superconducting wires.

In the superconducting coil according to the present invention, the cooling plate is preferably arranged to be cooled by, conduction from a refrigerator.

While a method of cooling the superconducting coil by arranging the cooling plate between the plurality of pancake coils according to the present invention is effective in a mode of dipping the coil in a coolant for cooling the same, temperature rise of the superconducting coil can be more effectively suppressed if the present invention is applied to a mode of cooling the coil by conduction from a refrigerator.

Preferably, the superconducting coil according to the present invention is arranged in a vacuum.

When a superconducting coil is arranged in a vacuum, heat insulation is simplified and a cryostat can be compactified, while the superconducting coil is cooled only by heat conduction. When the structure of the superconducting coil according to the present invention is applied to such case, the superconducting coil can be more effectively cooled.

The superconducting conductors forming the superconducting coil according to the present invention are preferably formed by tape-like superconducting wires.

While the shape of the wires employed for the superconducting coil according to the present invention is not limited, the pancake coils can be readily prepared and the cooling plate can be arranged between the plurality of pancake coils when tape-like superconducting wires are employed.

The superconducting conductors forming the superconducting coil according to the present invention preferably contain an oxide superconductor.

While the structure of the superconducting coil according to the present invention is not limited in relation to the type of a superconductor, the present invention is more effectively applied to a coil employing a highly stable oxide high-temperature superconductor.

A material employed as a composite material of such an oxide high-temperature superconductor, which is preferably prepared from silver or a silver alloy having excellent heat conductivity, is not particularly limited.

The oxide superconductor is preferably a bismuth superconductor.

The bismuth superconductor has particularly high stability among oxide high-temperature superconductors. When such a bismuth superconductor is applied to the superconducting coil according to the present invention, therefore, the superconducting coil can be more effectively efficiently cooled.

In order to further improve the cooling property for the superconducting coil according to the present invention, the cooling plate must be prepared from an excellent heat conductor. In general, however, an excellent heat conductor is electrically a low resistor. Such a low resistor causes eddy current loss when the magnetic field is changed in magnetization or demagnetization (hereinafter referred to as magnetization/demagnetization) of the superconducting coil, to result in heat generation. If the superconducting coil is conduction-cooled, the cooling plate must have a structure for conducting heat while causing no heat generation in magnetization/demagnetization of the coil.

In the superconducting coil according to the present invention, therefore, the cooling plate is preferably provided with a slit.

When the cooling plate is provided with a slit, heat generation caused by ac loss, particularly eddy current loss, can be suppressed to the minimum in magnetization/demagnetization of the superconducting coil. Consequently, the superconducting coil can be regularly efficiently cooled.

More preferably, the slit is formed on the cooling plate along a circumferential direction about the coil axis.

When the slit is formed along the circumferential direction about the coil axis, heat generation caused by eddy current loss can be suppressed without reducing the cooling property of the cooling plate in the heat conduction direction along the circumferential direction of the coil axis. Thus, the superconducting coil can be more effectively cooled.

The superconducting coil is cooled mainly in the coil axis direction. If compressive force in the coil axis direction is weak, however, contact heat resistance is increased to deteriorate the cooling efficiency for the superconducting coil. Therefore, the superconducting coil is preferably so formed that constant compressive force is regularly applied in the coil axis direction.

Preferably, compressive force of at least 0.05 kg/mm$^2$ and not more than 3 kg/mm$^2$ is applied to the superconducting coil according to the present invention in the coil axis direction. More preferably, compressive force of at least 0.2 kg/mm$^2$ and not more than 3 kg/mm$^2$ is applied in the coil axis direction. When compressive force of such a constant range is applied in the coil axis direction, contact heat resistance can be reduced. If higher compressive force is applied, however, the coil itself cannot withstand the compressive force but is deteriorated.

It is effective to employ a spring as means for applying compressive force in the coil axis direction. The superconducting coil is generally prepared under the room temperature and employed under a cryogenic temperature, and hence force resulting from heat distortion is also applied to the coil. Therefore, it is difficult to control the compressive force without employing a spring. When compressive force is applied in the coil axis direction with a spring, it is possible to apply prescribed compressive force in the coil axis direction with no influence by cooling distortion.

According to the present invention, as hereinabove described, the cooling property for the overall superconducting coil can be improved by arranging the cooling plate between the pancake coils, so that the superconducting coil can be operated even if the same remarkably generates heat. Due to the structure of the present invention, therefore, the superconducting coil can exhibit its performance to the maximum.

When the cooling plate is arranged on the portion where the magnetic field is provided in the direction perpendicular to the coil axis or on the end portion in the coil axis direction, an operating current can be increased without reducing the coil packing ratio.

When the cooling plate is provided with a slit, heat generation resulting from ac loss, particularly eddy current loss, can be suppressed in magnetization/demagnetization of the superconducting coil. Further, heat generation resulting from eddy current loss can be suppressed without reducing the conduction cooling property of the cooling plate by preferably forming the slit along the circumferential direction about the coil axis. Thus, the superconducting coil can maximally exhibit its performance also when magnetized/demagnetized.

Further, heat resistance in the superconducting coil can be reduced by applying compressive force to the coil in the coil axis direction within the prescribed range. Thus, the cooling property can be maximally exhibited for the superconducting coil of a conduction cooling type.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Example 1

A superconducting wire was prepared by coating a bismuth oxide superconductor mainly consisting of a 2223 phase $(Bi_xPb_{1-x})_2Sr_2Ca_2Cu_3O_y$ with silver. This tape-like superconducting wire was 3.6±0.4 mm in width and 0.23±0.02 mm in thickness. Three such tape-like superconducting wires were superposed with each other, and a stainless tape of SUS316 having a thickness of about 0.1 mm and a polyimide tape having a thickness of about 15 $\mu$m were successively superposed on these superconducting wires. A tape-like composite formed in this manner was wound on a bobbin, to prepare a double pancake coil of 65 mm in inner diameter, about 250 mm in outer diameter and about 8 mm in height. The critical current of the bismuth superconducting wire coated with silver was about 30 A (77 K) when the sectional area ratio of silver to the bismuth superconductor was 2.4.

12 such double pancake coils were stacked with and bonded to each other. These double pancake coils were electrically isolated from each other through FRP sheets of 0.1 mm in thickness.

Figure 1:
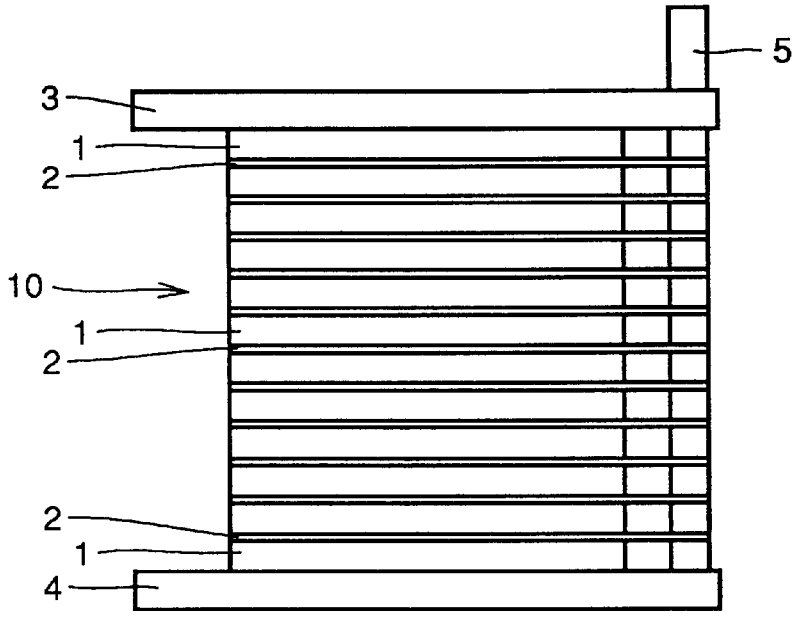
FIG. 1 is a side elevational view schematically showing the structure of a superconducting coil employed in each of Examples 1 and 3 of the present invention.

FIG. 1 shows a superconducting coil 10 obtained by stacking 12 double pancake coils 1 in the direction of a coil axis in the aforementioned manner. Copper plates 3 and 4 were arranged on upper and lower portions of the superconducting coil 10 respectively. Thus, the superconducting coil 10 was fixed to be held between the discoidal copper plates 3 and 4. Substantially discoidal cooling plates 2 of copper were arranged between the respective double pancake coils 1. In this case, the coil packing ratio was 71%.

Example 2

Figure 2:
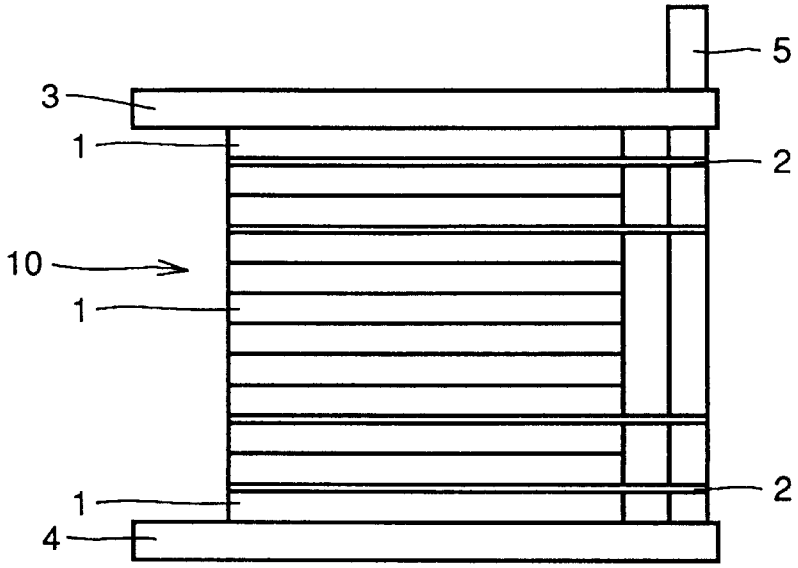
FIG. 2 is a side elevational view schematically showing the structure of a superconducting coil employed in Example 2 of the present invention.

FIG. 2 shows a superconducting coil 10 prepared in a similar manner to Example 1. Substantially discoidal cooling plates 2 of copper were arranged only on end portions in the direction of a coil axis of the superconducting coil 10. In this case, the coil packing ratio was 77%.

Comparative Example

Figure 3:
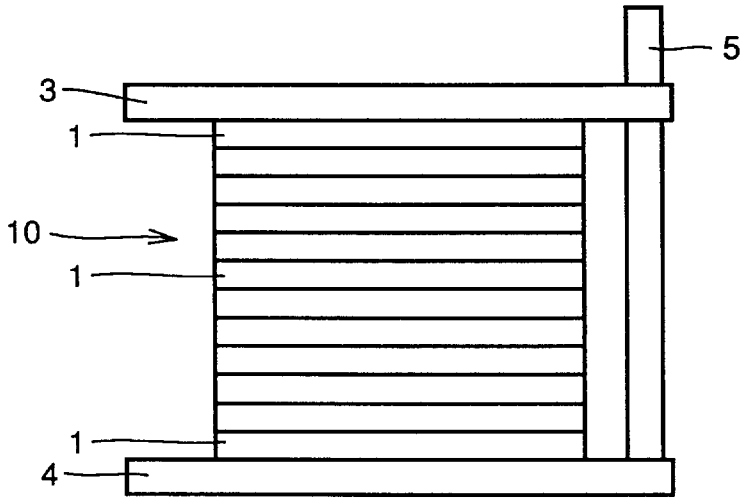
FIG. 3 is a side elevational view schematically showing the structure of a superconducting coil employed as comparative example.

FIG. 3 shows a comparative superconducting coil 10 prepared in a similar manner to Example 1. No cooling plates were arranged between double pancake coils 1. The coil packing ratio was 80%.

The superconducting coils 10 prepared in Examples 1 and 2 and comparative example were fixed to be held between the copper plates 3 and 4. The cooling plates 2 and the copper plates 3 and 4 were fixed to heat conduction bars 5 connected to cold heads of refrigerators.

Figure 4:
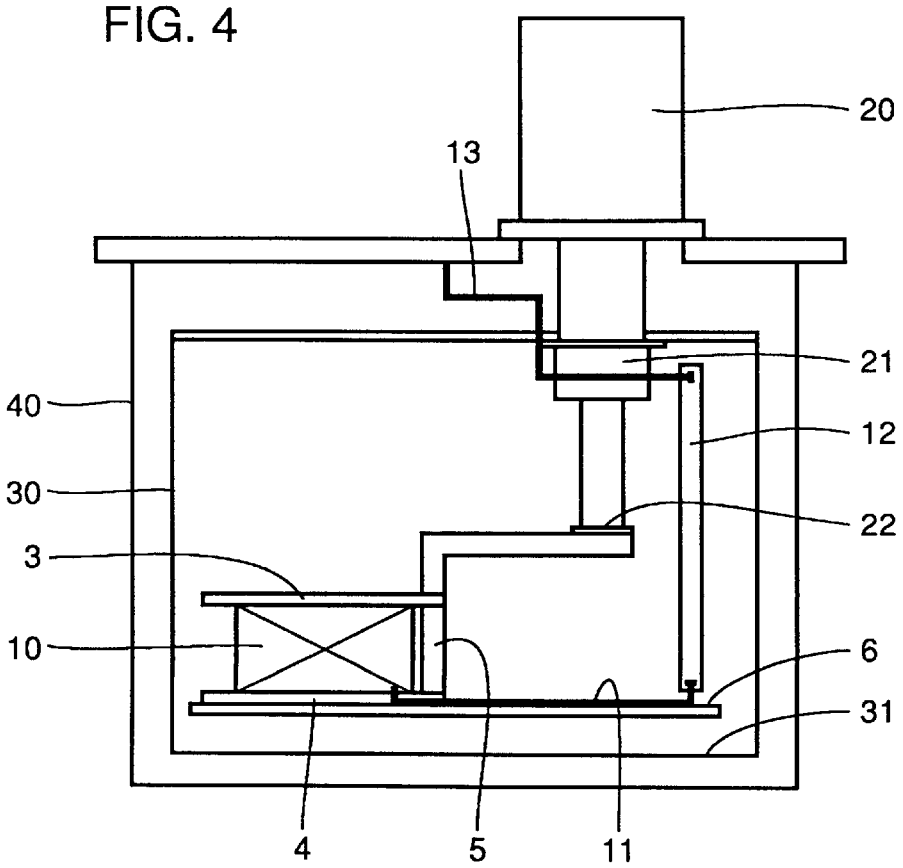
FIG. 4 schematically illustrates the structure of a refrigerator employed for cooling the superconducting coil according to the present invention.

As shown in FIG. 4, the heat conduction bar 5 for each superconducting coil 10 was thermally connected to a second stage 22 of a cold head of a refrigerator 20. The second stage 22 of the cold head extends from the refrigerator 20 through a first stage 21 of the cold head.

A current lead wire 11 consisting of an oxide high-temperature superconducting wire was connected to each superconducting coil 10. Another current lead wire 12 consisting of an oxide high-temperature superconducting wire was connected to the current lead wire 11. Still another current lead wire 13 consisting of a copper wire was connected to the current lead wire 12. Thus, the current lead wires 11 and 12 consisting of oxide high-temperature superconducting wires were arranged between the superconducting coil 10 and a temperature anchor part of the first stage 21 for suppressing heat invasion, while the current lead wire 13 consisting of a copper wire was arranged between the temperature anchor part of the first stage 21 and a portion under the room temperature. The superconducting coil 10 was stored in a vacuum vessel 30, which was provided with a heat shielding plate 31 for shielding the superconducting coil 10 against radiation heat. Another vacuum vessel 40 was provided for storing the vacuum vessel 30.

The cooling unit having the aforementioned structure was employed for feeding currents to the superconducting coils 10 according to Examples 1 and 2 and comparative example and measuring temperatures of the respective parts thereof.

Table 1 shows the initial cooling properties of the superconducting coils 10 with excitation currents of 0 A.

TABLE 1

| | Comparative Example (corresponds to the superconducting coil 10 shown in FIG. 3) | Example 1 (corresponds to the superconducting coils 10 shown in FIG. 1) | Example 2 (corresponds to the superconducting coils 10 shown in FIG. 2) |
|---|---|---|---|
| Coil Upper End | 11K | 11K | 11K |
| Coil Center | 11K | 11K | 11K |
| Coil Lower End | 11K | 11K | 11K |

As shown in Table 1, the respective parts of the superconducting coils 10 according to Examples 1 and 2 and comparative example were at the same temperature in the initial cooling properties.

Tables 2, 3 and 4 show temperatures measured at the respective parts of the superconducting coils 10 according to Example 1, Example 2 and comparative example after holding the coils 10 for 10 minutes at respective excitation current values in an excitation test respectively.

TABLE 2

| | 160A | 200A | 240A |
|---|---|---|---|
| Coil Upper End | 12K | 15K | 20K |
| Coil Center | 12K | 12K | 17K |
| Coil Lower End | 12K | 15K | 20K |

(Corresponds to the superconducting coils 10 shown in FIG. 1)

(Corresponds to the superconducting coils 10 shown in FIG. 1)

TABLE 3

| | 160A | 200A | 240A |
|---|---|---|---|
| Coil Upper End | 12K | 15K | 20K |
| Coil Center | 12K | 13K | 19K |
| Coil Lower End | 12K | 15K | 20K |

Corresponds to the superconducting coils 10 shown in FIG. 2)

Corresponds to the superconducting coils 10 shown in FIG. 2)

TABLE 4

| | 160A | 200A | 240A |
|---|---|---|---|
| Coil Upper End | 12K | 16K | |
| Coil Center | 13K | 18K | inoperable |
| Coil Lower End | 12K | 16K | |

Corresponds to the superconducting coils 10 shown in FIG. 3)

Corresponds to the superconducting coils 10 shown in FIG. 3)

From the results shown in Tables 2 to 4, it is understood that the respective parts of the superconducting coils 10 having the cooling plates 2 arranged between the pancake coils 1 according to Examples 1 and 2 exhibited lower temperatures and the overall superconducting coils 10 were efficiently cooled. It is also understood that cooling effects remarkably appeared as the excitation current values were increased, due to remarkable heat generation of the superconducting coils 10. The superconducting wires 10 according to Examples 1 and 2 were intolerant of magnetic fields perpendicular to the tape surfaces and hence remarkably generated heat on the end portions in the coil axis direction.

Therefore, the cooling effects for the superconducting coils 10 having the cooling plates 2 arranged between the respective double pancake coils 1 and those arranged only on the end portions of the superconducting coil 10 respectively were hardly different from each other. In Example 2, the superconducting coil 10 generated heat of about 1 W and about 8 W with operating currents of 200 A and 240 A respectively.

Example 3

A superconducting wire was prepared by coating a bismuth oxide superconductor mainly consisting of a 2223 phase $(Bi_xPb_{1-x})_2Sr_2Ca_2Cu_3O_y$ with silver. This tape-like superconducting wire was 3.6±0.4 mm in width and 0.23±0.02 mm in thickness. Three such tape-like superconducting wires were superposed with each other, and a stainless tape of SUS316 having a thickness of about 0.05 mm and a polyimide tape having a thickness of about 15 $\mu$m were successively superposed on these superconducting wires. A tape-like composite formed in this manner was wound on a bobbin, to prepare a double pancake coil of 80 mm in inner diameter, about 250 mm in outer diameter and about 8 mm in height. The critical current of the bismuth superconducting wire coated with silver was about 30 to 40 A (77 K) when the sectional area ratio of silver to the bismuth superconductor was 2.4.

12 such double pancake coils were stacked with and bonded to each other. These double pancake coils were electrically isolated from each other through FRP sheets of 0.1 mm in thickness.

A superconducting coil 10 obtained in the aforementioned manner also had the structure shown in FIG. 1, with 12 double pancake coils 1 stacked in the coil axis direction. Copper plates 3 and 4 were arranged on upper and lower portions of this superconducting coil 10 respectively. Thus, the superconducting coil 10 was fixed to be held between the discoidal copper plates 3 and 4. Substantially discoidal cooling plates 2 of copper were arranged between the respective double pancake coils 1. The cooling plates 2 and the copper plates 3 and 4 were fixed to a heat conduction bar 5 which was connected to a cold head of a refrigerator. In this case, the coil packing ratio was 80%.

The heat conduction bar 5 was thermally connected to a second stage 22 of a cold head of a refrigerator 20, as shown in FIG. 4. The second stage 22 of the cold head extends from the refrigerator 20 through a first stage 21 of the cold head.

A current lead wire 11 consisting of an oxide high-temperature superconducting wire was connected to the superconducting coil 10. Another current lead wire 12 consisting of an oxide high-temperature superconducting wire was connected to the current lead wire 11. Still another current lead wire 13 consisting of a copper wire was connected to the current lead wire 12. Thus, the current lead wires 11 and 12 consisting of oxide high-temperature superconducting wires were arranged between the superconducting coil 10 and the temperature anchor part of the first stage 21 for suppressing heat invasion, while the current lead wire 13 consisting of a copper wire was arranged between the temperature anchor part of the first stage 21 and a portion under the room temperature. The superconducting coil 10 was stored in a vacuum vessel 30, which was provided with a heat shielding plate 31 for shielding the superconducting coil 10 against radiation heat. Another vacuum vessel 40 was provided for storing the vacuum vessel 30.

Figure 5:
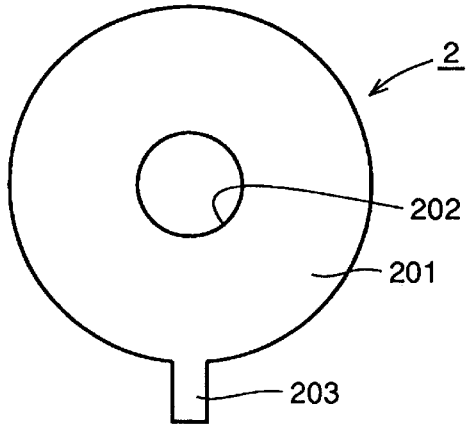
FIG. 5 is a plan view showing a structure 1 of a cooling plate employed in Example 3 of the present invention.
Figure 6:
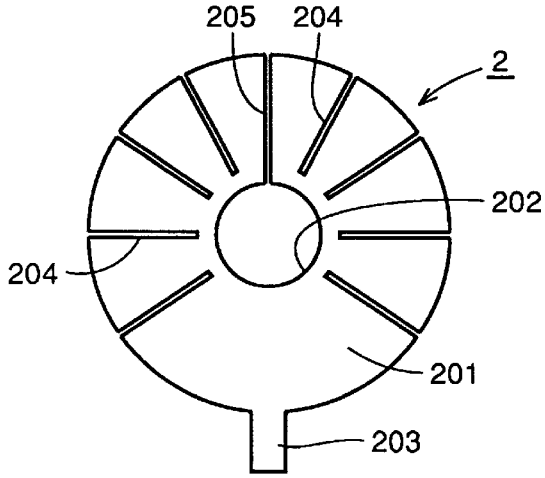
FIG. 6 is a plan view showing a structure 2 of the cooling plate employed in Example 3 of the present invention.
Figure 7:
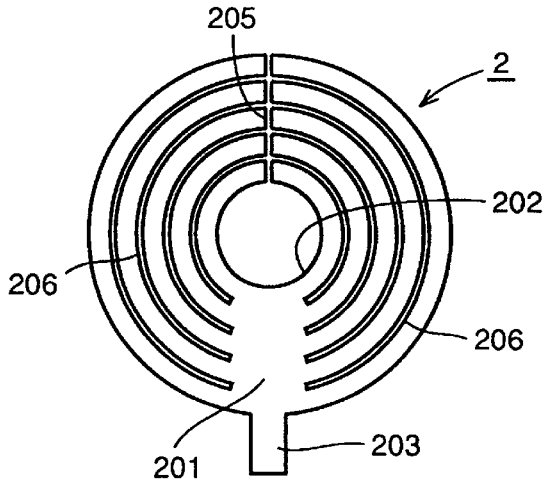
FIG. 7 is a plan view showing a structure 3 of the cooling plate employed in Example 3 of the present invention.

The cooling unit having the aforementioned structure was employed for feeding a current to the superconducting coil 10 and measuring its temperature in magnetization/demagnetization. At this time, the cooling plates 2 arranged between the double pancake coils 1 shown in FIG. 1 were prepared in three types of structures. FIGS. 5 to 7 are plan views showing structures 1, 2 and 3 of the cooling plates 2 respectively.

In the structure 1 shown in FIG. 5, the cooling plate 2 consists of a doughnut part 201 and a part 203 closer to the heat conduction bar 5, with a hole 202 formed at the center of the doughnut part 201.

In the structure 2 shown in FIG. 6, the cooling plate 2 consists of a doughnut part 201 and a part 203 closer to the heat conduction bar 5, with a hole 201 formed at the center of the doughnut part 201 and radial slits 204 extending from the outer periphery toward the inner periphery of the doughnut part 201. Further, a divisional slit 205 vertically extends from the outer periphery toward the inner periphery of the doughnut part 201 in FIG. 6, to circumferentially divide the doughnut part 201.

In the structure 3 shown in FIG. 7, the cooling plate 2 consists of a doughnut part 201 and a part 203 closer to the heat. conduction bar 5, with a hole 201 formed at the center of the doughnut part 201 and a plurality of circumferential slits 206 having different diameters formed between the outer and inner peripheries of the doughnut part 201. Further, a divisional slit 205 vertically extends from the outer periphery toward the inner periphery of the doughnut part 201 in FIG. 6, to circumferentially divide the doughnut part 201.

Each of superconducting coils 10 having the cooling plates 2 of the structures 1 to 3 was magnetized/demagnetized with an excitation current of 200 A causing small heat generation by electrical resistance, at a sweep rate of 1 minute. Table 5 shows results of measurement of temperature characteristics of the superconducting coils 10 in magnetization/demagnetization.

TABLE 5

| | Structure 1 | Structure 2 | Structure 3 |
|---|---|---|---|
| Coil Temperature | 20K | 19K | 17K |

As shown in Table 5, the temperature of the superconducting coil 10 employing the cooling plates 2 of the structure 1 having no slits was 20 K, while the superconducting coil 10 employing the cooling plates 2 of the structure 2 having a plurality of slits 204 in the radial direction exhibited a low temperature value of 19 K and the superconducting coil 10 employing the cooling plates 2 of the structure 3 having the plurality of slits 206 along the circumferential direction exhibited a lower temperature of 17 K. Thus, it is understood possible to reduce eddy current loss in each cooling plate 2 thereby suppressing heat generation to the minimum by forming the divisional slit 205 in the cooling plate 2. The cooling plates 2 of the structure 3 exhibited superior cooling efficiency for the superconducting coil 10 to those of the structure 2 conceivably because the circumferential slits 206 were able to suppress heat generation resulting from eddy current loss while keeping circumferential heat conduction, i.e., without reducing cooling properties in the structure 3, although circumferential heat conduction was slightly reduced in the structure 2 due to formation of the plurality of radial slits 204.

After kept at an excitation current value of 200 A for 1 hour, the superconducting coils 1 employing the cooling plates 2 of the structures 1 to 3 exhibited substantially equal temperatures of about 12 K, and the cooling properties remained unchanged when the superconducting coils 1 were not magnetized/demagnetized.

Example 4

Figure 9:
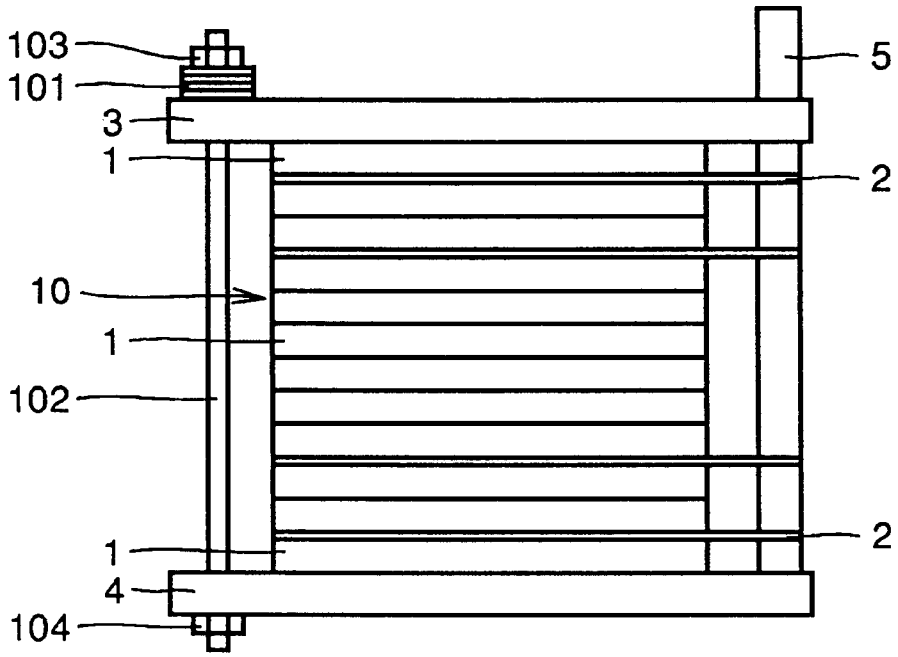
FIG. 9 is a side elevational view schematically showing the structure of a superconducting coil employed in Example 6 of the present invention.

A superconducting coil 10 shown in FIG. 9 was prepared similarly to Example 3. Referring to FIG. 9, a spring 103 was arranged on a copper plate 3 for applying compressive force to the superconducting coil 10, which was similar to that shown in FIG. 2, in the direction of a coil axis. A plurality of such springs 101 (not shown) were circumferentially arranged on the copper plate 3. Each spring 101 was fixed through a bolt 102 and nuts 103 and 104. Substantially discoidal cooling plates 2 were arranged only on end portions in the coil axis direction of the superconducting coil 10. The cooling plates 2 were in the structure 1 shown in FIG. 5. A refrigerator was formed similarly to that shown in FIG. 4 for measuring coil temperatures, similarly to Example 3. Compressive force applied in the coil axis direction was varied for measuring the coil temperatures at the respective levels of the compressive force. The excitation current value was 295 A, and the overall superconducting coil 10 generated heat of 1 W. Table 6 shows the temperatures of the respective parts of the superconducting coil 10 measured at the respective levels of the compressive force applied in the coil axis direction.

TABLE 6

| Compressive Force in Coil Axis Direction ($kg/mm^2$) | 0 | 0.05 | 0.2 | 0.3 | 3.0 |
|---|---|---|---|---|---|
| Coil Upper End | 14K | 14K | 13K | 13K | 13K |
| Coil Center | 25K | 18K | 14K | 14K | 14K |
| Coil Lower end | 14K | 14K | 13K | 13K | 13K |

From the results shown in Table 6, it is understood that a cooling effect appeared at a central part of the superconducting coil 10 when the compressive force in the coil axis direction was at least 0.05 $kg/mm^2$, and the respective parts of the superconducting coil 10 were kept at low temperatures when the compressive force exceeded 0.2 $kg/mm^2$. Thus, the overall superconducting coil 10 was effectively cooled.

Example 5

A superconducting wire was prepared by coating a bismuth oxide superconductor mainly consisting of a 2223 phase $(Bi_xPb_{1-x})_2Sr_2Ca_2Cu_3O_y$ with silver. This tape-like superconducting wire was 3.6±0.4 mm in width and 0.23±0.02 mm in thickness. Four such tape-like superconducting wires were superposed with each other, and a stainless tape of SUS316 having a width of about 3.5 mm and a thickness of about 0.2 mm and a polyimide tape having a thickness of 100 $\mu$m were successively superposed on these superconducting wires. A tape-like composite formed in this manner was wound on a bobbin, to prepare a double pancake coil of 940 mm in inner diameter, about 1010 mm in outer diameter and about 8 mm in height. The critical current of the bismuth superconducting wire coated with silver was about 30 to 40 A (77 K) when the sectional area ratio of silver to the bismuth superconductor was 2.2.

20 double pancake coils prepared in the aforementioned manner were stacked with and soldered to each other. The double pancake coils were electrically isolated from each other through FRP sheets of 0.1 mm in thickness.

Figure 8:
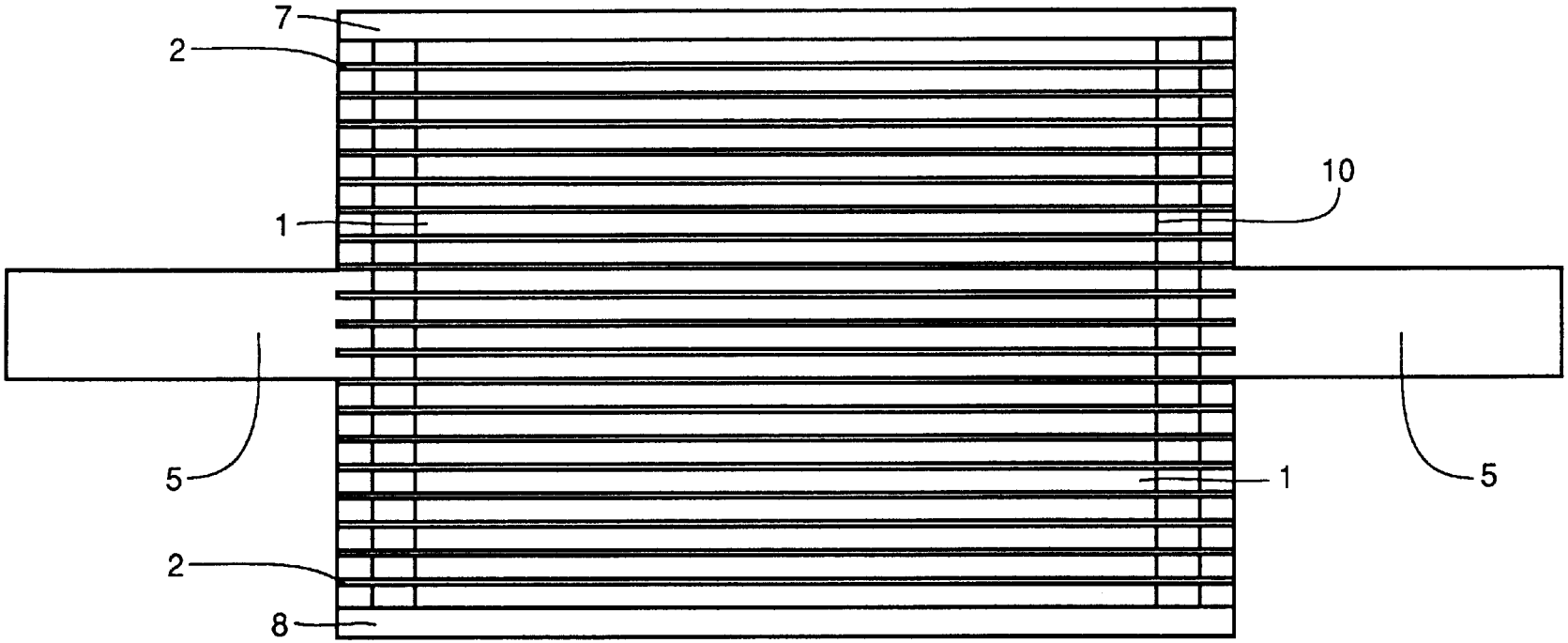
FIG. 8 is a side elevational view schematically showing the structure of a superconducting coil employed in Example 5 of the present invention.

FIG. 8 shows a superconducting coil 10 obtained in the aforementioned manner by stacking 20 double pancake coils 1 in the coil axis direction. Stainless plates 7 and 8 were arranged on upper and lower portions of the superconducting coil 10 respectively. Thus, the superconducting coil 10 was fixed to be held between the discoidal stainless plates 7 and 8. Substantially discoidal cooling plates 2 of an aluminum alloy having a thickness of 0.8 mm were arranged between the double pancake coils 1. The cooling plates 2 and the stainless plates 7 and 8 were fixed to heat conduction bars 5 which were connected to cold heads of refrigerators. In this Example, two refrigerators were employed for cooling the large-sized superconducting coil 10. The superconducting coil 10 was prepared under the room temperature.

Current lead wires consisting of oxide high-temperature superconducting wires were arranged between the superconducting coil 10 and temperature anchor parts of first stages for suppressing heat invasion, while copper wires were arranged between the temperature anchor parts of the first stages and portions under the room temperature. The superconducting coil 10 was shielded against radiation heat by heat shielding plates.

The superconducting coil 10 was cooled to about 15 K with the refrigerators, and then operated with an excitation current. While the excitation current was increased to 290 A, the superconducting coil 10 exhibited a stable operating property.

Then, the superconducting coil 10 was returned to the state of the room temperature, and impregnated with resin. After sufficiently impregnated with epoxy resin, the superconducting coil 10 was heat-treated in an atmosphere of 120° C. for about 1.5 hours, for hardening the epoxy resin. The superconducting coil 10 impregnated with the resin was cooled with the refrigerators, and supplied with an excitation current for examining a coil excitation property. Consequently, the superconducting coil 10 exhibited performance equivalent to that before impregnation with the epoxy resin. Thus, it is understood that the cooling property for the superconducting coil 10 with the cooling plates remained unchanged although the same was heat-treated at 120° C. to be impregnated with the resin.

In the structure of the inventive superconducting coil, the cooling plates are preferably prepared from a metal material such as gold, silver, copper, aluminum or an alloy thereof, which is not recrystallized by heat treatment at a temperature up to 130°C. for impregnating the superconducting coil with resin. Further, it is preferable to employ cooling plates having a thickness within the range of 0.3 to 3.0 mm. No effect of improving the cooling property is attained if the thickness of the cooling plates is too small, while a coil packing factor (occupied volume ratio of the superconducting wires in the coil) is reduced if the thickness of the cooling plates is too large. In addition, it is preferable that the cooling plates are directly electrically and thermally connected to the refrigerator with interposition of no insulator. If the cooling plates are connected to the refrigerator through an insulator, the cooling property is reduced.

The structure of the superconducting coil according, to the present invention is preferably applied to a coil which is prepared by the react-and-wind method.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A superconducting coil formed by stacking a plurality of pancake coils with each other, said superconducting coil comprising:

a first pancake coil prepared by winding a superconducting conductor;

a second pancake coil, prepared by winding a superconducting conductor, that is stacked on said first pancake coil in the direction of a coil axis; and a cooling plate arranged between said first and second pancake coils.

2. The superconducting coil in accordance with claim 1, wherein said cooling plate is arranged on a portion providing a magnetic field perpendicularly to said coil axis.

3. The superconducting coil in accordance with claim 1, wherein said cooling plate is arranged on an end portion in the direction of said coil axis in said superconducting coil.

4. The superconducting coil in accordance with claim 1, wherein said coil is contained in a vacuum.

5. The superconducting coil in accordance with claim 1, wherein said superconducting conductors are formed by superconducting wires having tape-like shapes.

6. The superconducting coil in accordance with claim 1, wherein said superconducting conductor includes an oxide superconductor.

7. The superconducting coil in accordance with claim 1, wherein said oxide superconductor is a bismuth superconductor.

8. The superconducting coil in accordance with claim 1, wherein said cooling plate is provided with a slit.

9. The superconducting coil in accordance with claim 1, wherein said slit is formed along a circumferential direction about said coil axis.

10. The superconducting coil in accordance with claim 1, wherein compressive force of at least 0.05 $kg/mm^2$ and not more than 3 $kg/mm^2$ is applied in the direction of said coil axis.

11. The superconducting coil in accordance with claim 1, wherein compressive force of at least 0.2 $kg/mm^2$ and not more than 3 $kg/mm^2$ is applied in the direction of said coil axis.

12. The superconducting coil in accordance with claim 1, wherein said compressive force is applied by a spring.

13. The superconducting coil in accordance with claim 9, wherein said cooling plate comprises radial slits.

14. The superconducting coil in accordance with claim 1, wherein said cooling plate comprises a center hole and wherein one of said radial slits extends from an outer periphery of said cooling plate to said center hole.

15. The superconducting coil in accordance with claim 10, wherein said cooling plate comprises a center hole and wherein a radial slit extends from an outer periphery of said cooling plate to said center hole.

16. The superconducting coil in accordance with claim 9, wherein said cooling plate is provided with a plurality of slits.

17. The superconducting coil in accordance with claim 10, wherein said slits are formed along a circumferential direction about said coil axis.

* * * * *